US007753830B1

(12) United States Patent
Marsh et al.

(10) Patent No.: US 7,753,830 B1
(45) Date of Patent: Jul. 13, 2010

(54) EXERCISE EQUIPMENT WITH DOCK-AND-LOCK AND SPOTTER PLATFORM

(75) Inventors: Jeffrey A. Marsh, Newport, KY (US); Clay J. Steffee, Alexandria, KY (US)

(73) Assignee: Brunswick Corporation, Lake Forest, IL (US)

( * ) Notice: Subject to any disclaimer, the term of this patent is extended or adjusted under 35 U.S.C. 154(b) by 78 days.

(21) Appl. No.: 12/127,094

(22) Filed: May 27, 2008

(51) Int. Cl.
*A63B 26/00* (2006.01)

(52) U.S. Cl. ..... 482/142; 482/104; 482/908

(58) Field of Classification Search ..... 482/92–104, 482/135–137, 142, 145, 908; 248/129, 297.21, 248/297.31, 297.51; 16/33, 34
See application file for complete search history.

(56) References Cited

U.S. PATENT DOCUMENTS 5,649,886 A * 7/1997 Danylieko ..... 482/142
6,605,023 B1 * 8/2003 Mobley ..... 482/142
6,685,601 B1 * 2/2004 Knapp ..... 482/104
6,966,872 B2 * 11/2005 Eschenbach ..... 482/142
7,147,594 B1 * 12/2006 Vittone ..... 482/142
7,204,791 B1 4/2007 Baumler et al.
7,331,912 B2 * 2/2008 Keiser et al. ..... 482/142
7,585,259 B2 * 9/2009 Turner ..... 482/104
7,632,221 B1 * 12/2009 Kolander ..... 482/94
2007/0155597 A1 * 7/2007 Hockemeyer ..... 482/99
2009/0143203 A1 * 6/2009 Knapp ..... 482/104
2009/0203505 A1 * 8/2009 Kroll et al. ..... 482/104

OTHER PUBLICATIONS

Exhibit A, Admitted Prior Art, at least as early as Jun. 14, 2007.
Exhibit B, Admitted Prior Art, at least as early as Feb. 19, 2007.

* cited by examiner

*Primary Examiner*—Loan H Thanh
*Assistant Examiner*—Daniel F Roland
(74) *Attorney, Agent, or Firm*—Andrus, Sceales, Starke & Sawall, LLP

(57) ABSTRACT

Exercise equipment includes a stationary dock and a user support frame engaging the dock in docking relation, including application as a weight training rack and bench including a weight rack frame and a bench frame releasably lockable to the weight rack frame at a plurality of selectable locking locations therealong. A pair of collapsible spotter platforms are mounted to respective upstanding support posts.

28 Claims, 11 Drawing Sheets

182
30
180
186
36
40
38
48
184
39
34
122
114
32
120
62

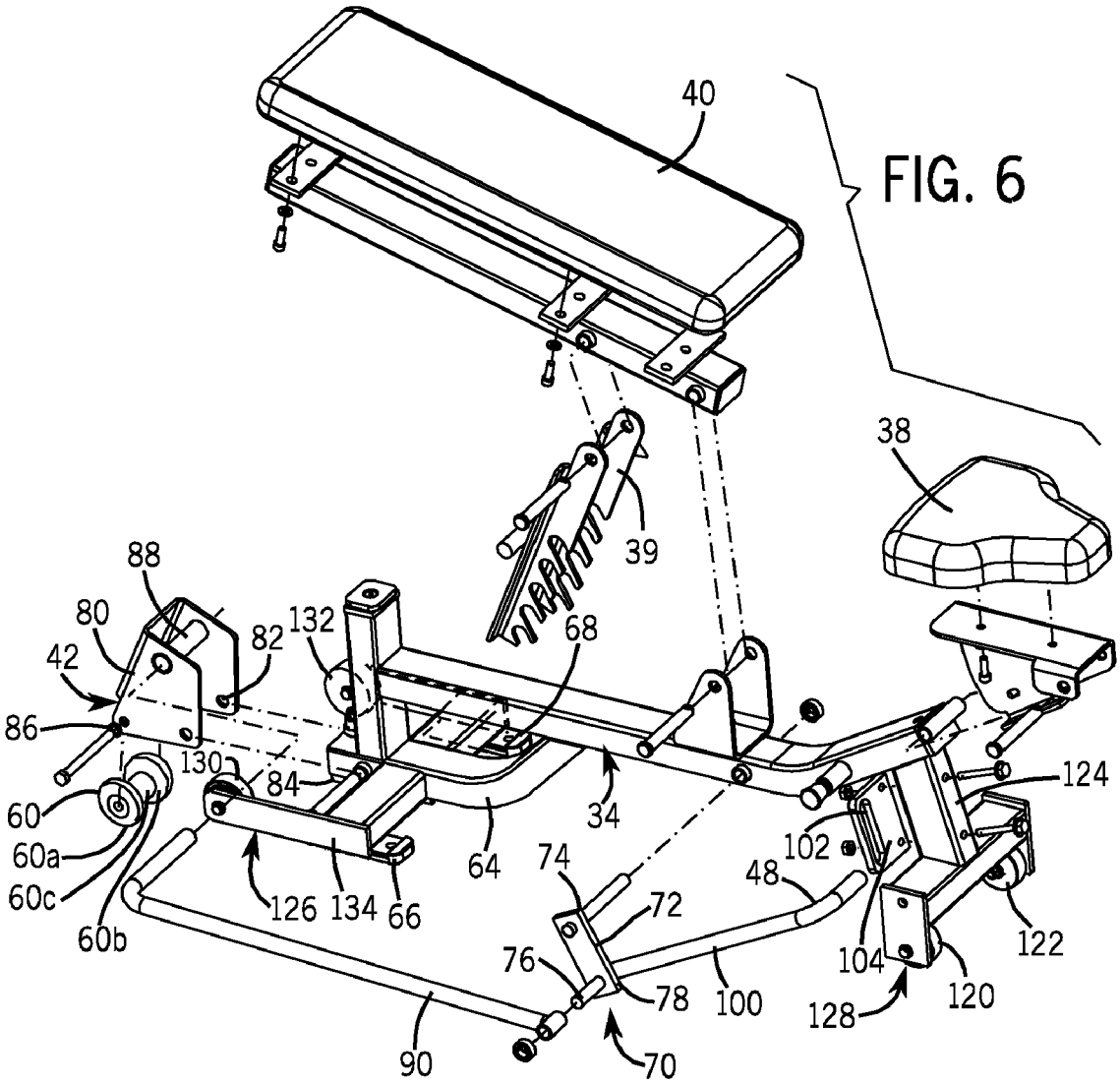
FIG. 6
FIG. 7
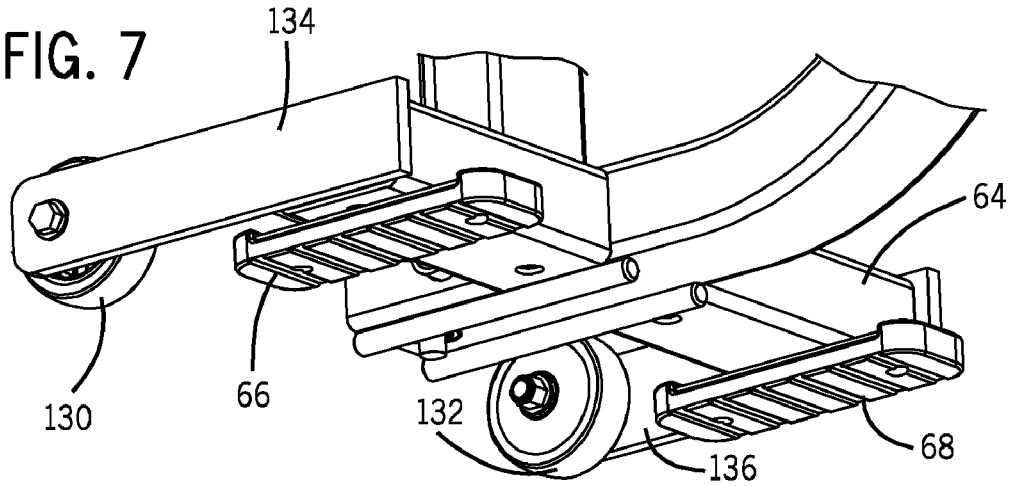

FIG. 8
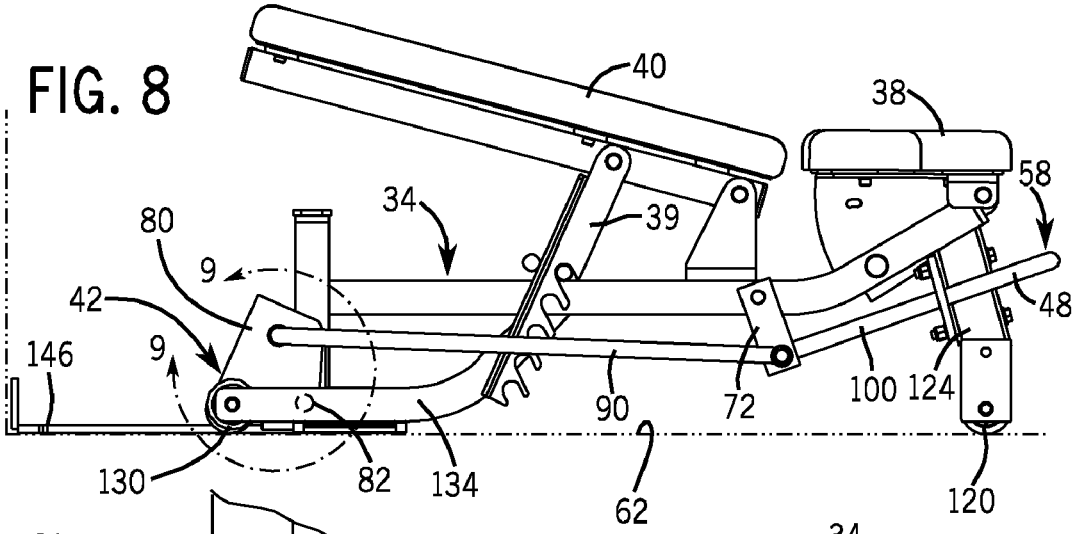
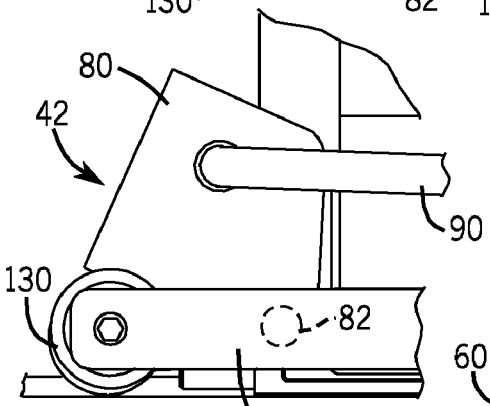
FIG. 9
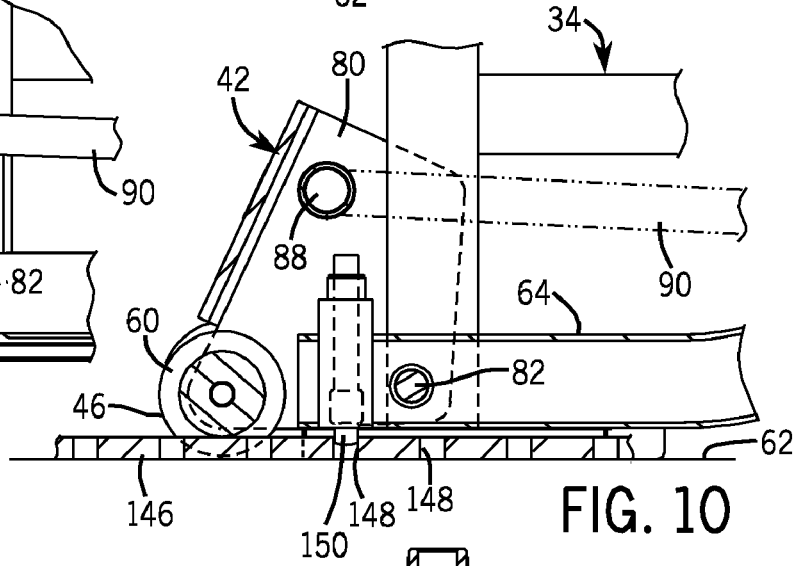
FIG. 10
FIG. 19
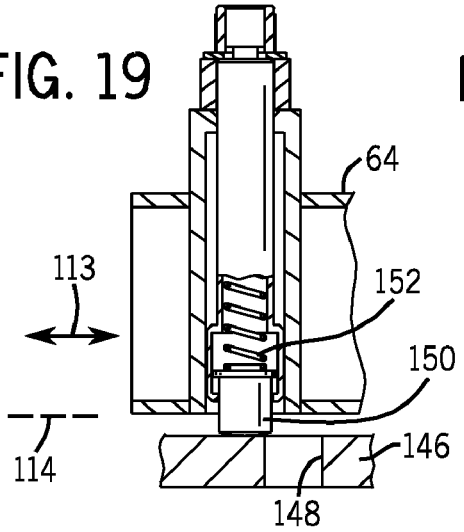
FIG. 20
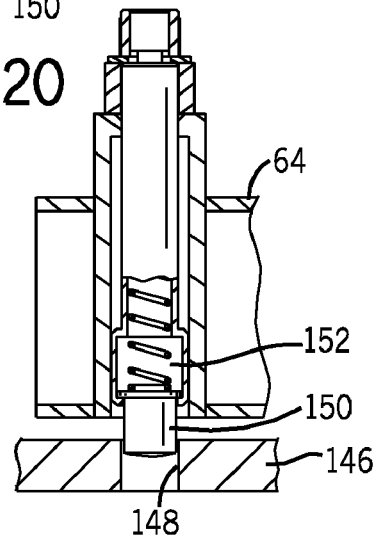

EXERCISE EQUIPMENT WITH DOCK-AND-LOCK AND SPOTTER PLATFORM

BACKGROUND AND SUMMARY

The invention relates to exercise equipment, including weight training equipment, including olympic style weight racks and benches.

Olympic style weight racks and benches require rigidity and stability while in use. This is accomplished by positively securing the bench to the rack while it is in use. However, to maximize effective use of a bench, the relationship between the user and the rack needs to be adjustable. For example, the positioning of a person doing a flat press is different from a military press. The challenge is to simultaneously achieve a rigid bench that is adjustable relative to the rack.

The use of olympic weight racks often requires one or more spotters, who need to be positioned relative to the athlete to achieve maximize advantage when assisting the athlete during training. Exercises such as an incline or military press require the spotter to be elevated from the floor for maximum efficiency. It is desirable to provide a collapsible spotter platform that can be extended for certain exercises, and retracted for other exercises such as flat presses. squats, and other training routines that do not require an elevated spotter. This provides the most efficient use of space, and the least amount of effort and/or inconvenience for the user.

The present invention arose during continuing development efforts in the above technology and has application thereto and to other applications.

BRIEF DESCRIPTION OF THE DRAWINGS

FIG. 6 is an exploded perspective view of the apparatus of FIG. 4.

FIG. 7 is an isometric view from below of a portion of the apparatus of FIG. 4.

FIG. 8 is a side view of the apparatus of FIG. 4.

FIG. 9 is an enlarged view of a portion of the apparatus of FIG. 8 taken along line 9-9.

FIG. 10 is a view like FIG. 9 partially cutaway.

FIG. 19 is an enlarged view of a portion of FIG. 10, and showing one operational mode.

FIG. 20 is like FIG. 19 and shows another operational mode.

DETAILED DESCRIPTION

Figure 1:
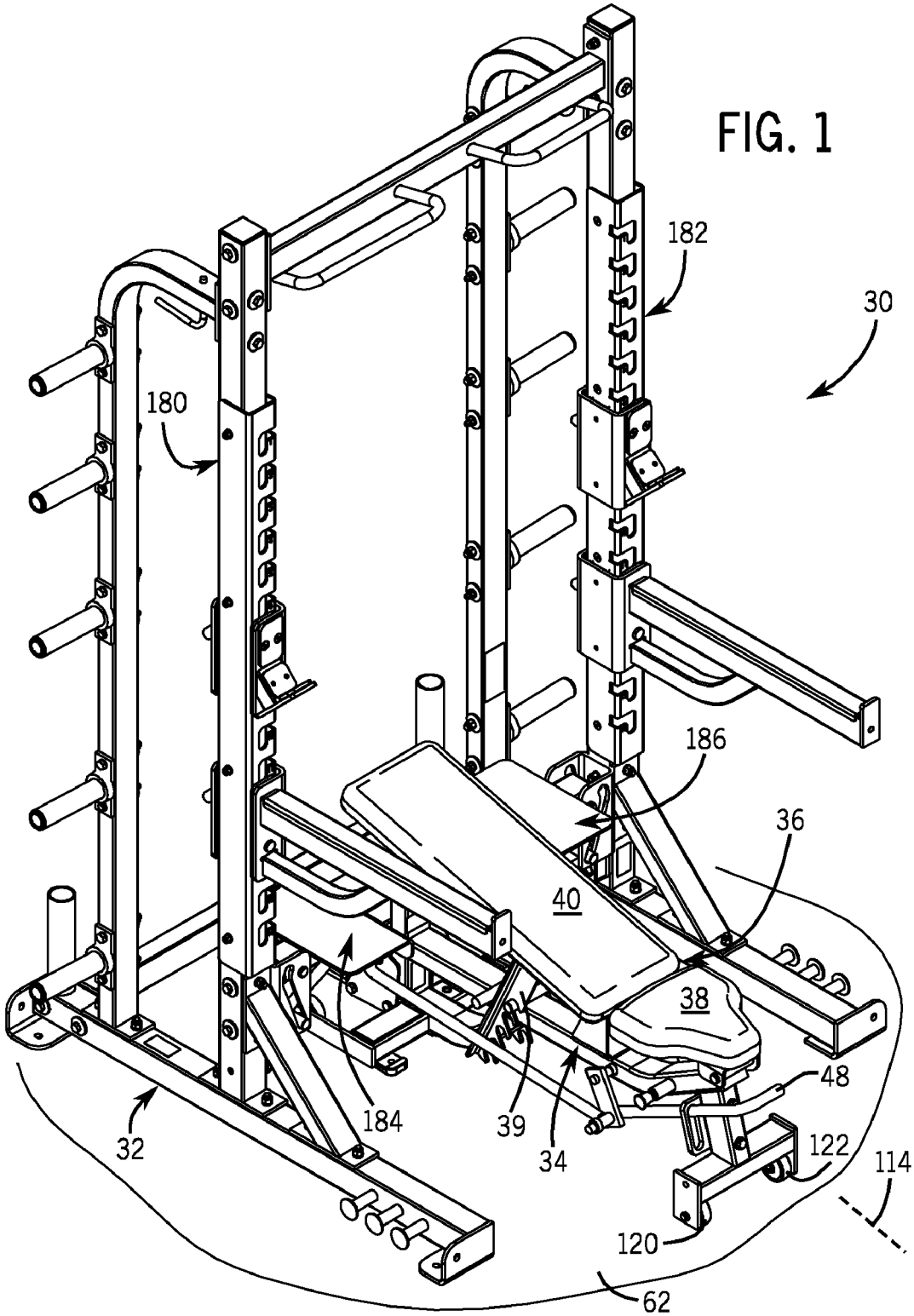
FIG. 1 is a perspective view of exercise equipment in accordance with the invention, including a weight training rack and bench.
Figure 11:
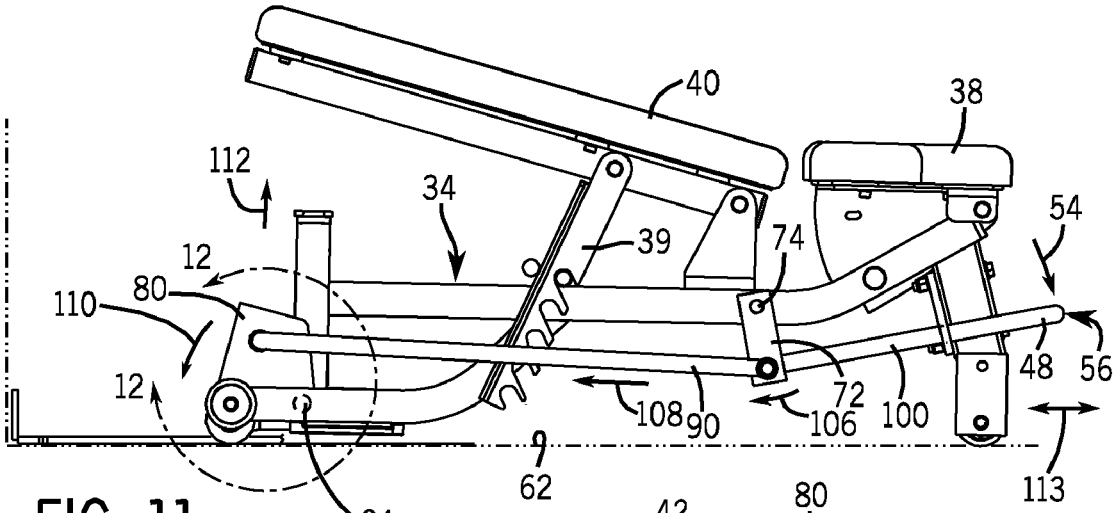
FIG. 11 is like FIG. 8 and shows a further operational mode.
Figure 12:
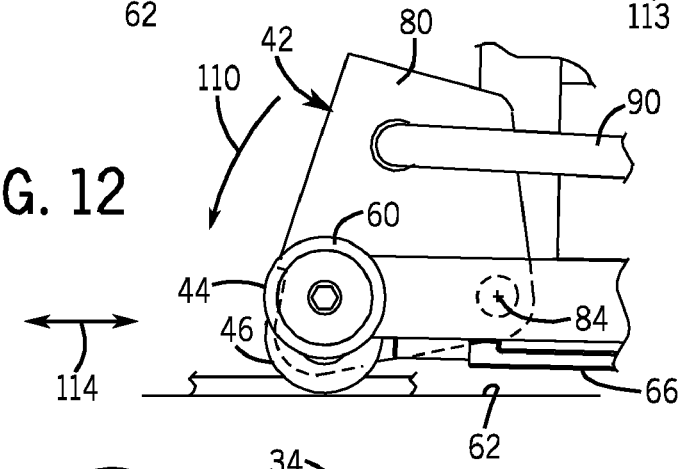
FIG. 12 is an enlarged view of a portion of the apparatus of FIG. 11 taken along line 12-12.
Figure 16:
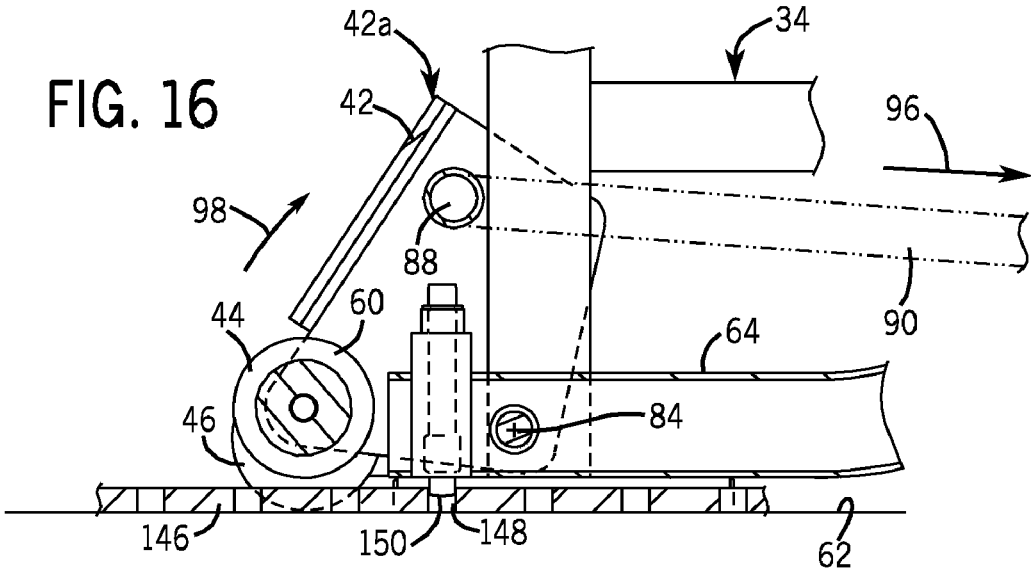
FIG. 16 is like FIG. 15, enlarged and partially cutaway.

FIG. 1 shows exercise equipment 30 including a stationary dock 32 and a user support frame 34 engaging the dock in docking relation and releasably lockable thereto at a plurality of selectable locking locations therealong. In one embodiment, the exercise equipment is a weight training rack and bench, and the stationary dock is a weight rack frame 32 for supporting one or more training weights, and the user support frame is a bench frame 34 for supporting a user bench 36, for example a seat 38 and a seat back 40. A locking member 42, FIGS. 4, 6, to be described, releasably locks user support frame 34 to dock 32. The locking member is actuatable between a first locking position 42*a*, FIG. 16, locking user support frame 34 to dock 32 at a selected one of the noted locking locations, and a second release position 42*b*, FIG. 13, releasing user support frame 34 from dock 32. A user-operated handle 48 is operable, as shown at arrow 50, FIGS. 4, 14, to a first condition (e.g. an upward position in the drawings as shown at position 52, FIG. 14) which actuates locking member 42 to its locking position at a selected one of the noted locking locations. User-operated handle 48 is operable as shown at arrow 54, FIG. 11, to a second condition (e.g. to a downward position as shown at position 56, FIG. 11) which both: a) actuates locking member 42 to its release position to release user support frame 34 from dock 32; and b) enables movement of user support frame 34 to a different one of the noted locking locations, to be described. User-operated handle 48 has a central neutral position as shown at position 58 in FIG. 8. In the preferred embodiment, locking member 42 is in a locking condition when handle 58 is in its neutral position, to be described.

A roller 60, FIG. 6, is mounted to user support frame 34, preferably at locking member 42 and is movable relative to the user support frame between a first raised position 44, FIGS. 12, 13, 15, 16, and a second lowered position 46. Roller 60 in the lowered position engages the floor 62 which supports dock 32 and user support frame 34. Roller 60 in its lowered position raises user support frame 34 above floor 62 and actuates locking member 42 to its release position and out of engagement with the dock. Roller 60 in its raised position lowers user support frame 34 and actuates locking member 42 to its locking position and enables re-engagement of locking member 42 and the dock. In the preferred embodiment, user support frame 34 has a lower frame portion 64 having pads such as 66, 68 on the underside thereof, FIGS. 5, 7, which rest on floor 62 when roller 60 is in its raised position 44. When roller 60 is in its lowered position 46, pads 66, 68 are lifted above floor 62, and roller 60 rolls along floor 62 to enable re-positioning of user support frame 34 to a selected one of the noted locking locations along dock 32, to be described.

Figure 4:
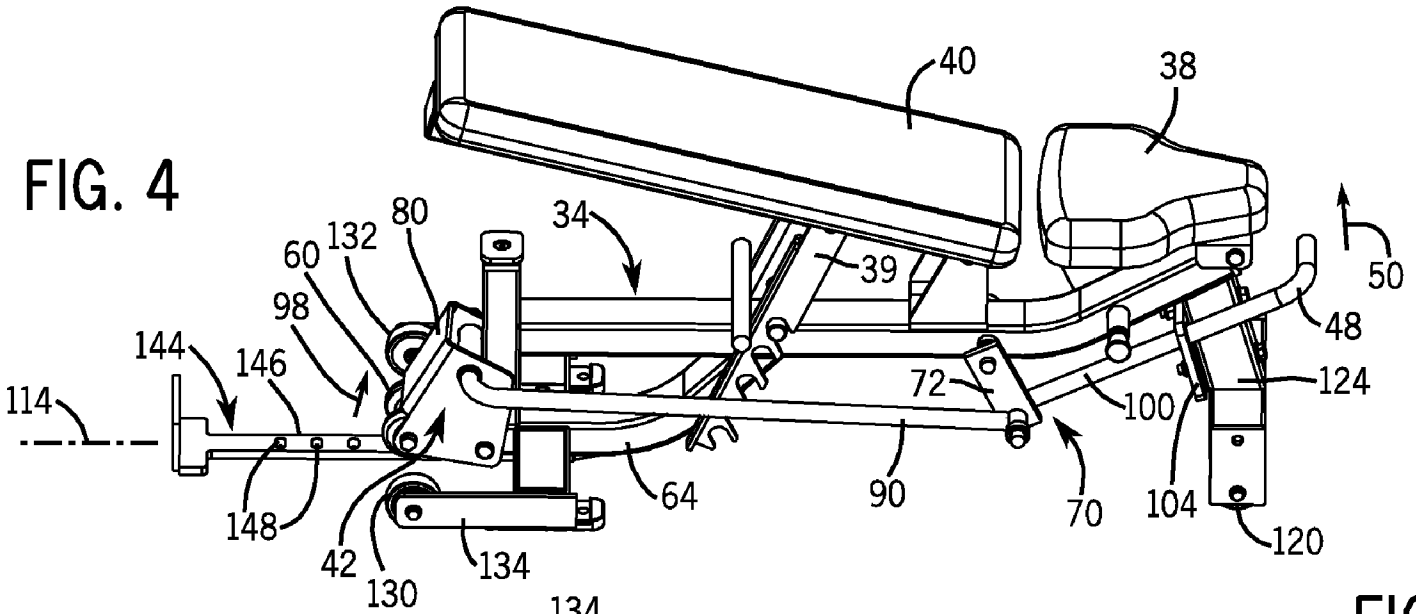
FIG. 4 is a perspective view of a portion of the apparatus of FIG. 1.

Handle 48 is coupled to roller 60 at locking member 42 by pivoted linkage 70, FIGS. 4, 6, connected to user support frame 34. The linkage is provided by a multi-link multi-pivot linkage having: a first link 72 having a first pivot 74 connected to user support frame 34, a second pivot 76, and a handle-connection portion 78 connected to handle 48, preferably rigidly connected thereto, as by welding; a second link 80 having a third pivot 82 connected to user support frame 34, e.g. at trunnions such as 84, a fourth pivot 86 journaling roller 60, and a fifth pivot 88; and a third link 90 pivotally connected between pivot 76 of link 72 and pivot 88 of link 80. Upon upward movement of handle 48 as shown at arrow 50 in FIGS. 4, 14, link 80 pivots clockwise as shown at arrow 92 about pivot 84 such that roller 60 is raised to its raised position 44. During upward movement of handle 48 as shown at arrow 50, link 72 pivots counterclockwise as shown at arrow 94 about pivot 74, and link 90 moves rightwardly as shown at arrow 96 in FIG. 15, to in turn cause the noted clockwise pivoting of link 80 as shown at arrow 92 about pivot 84, to in turn raise roller 60 upwardly as shown at arrow 98, FIGS. 4, 16. The handle 48 includes an extension section 100 extending rearwardly therefrom to link 72, which extension section 100 may be guided for up-down translational movement along slot 102 formed in a bracket 104 attached to the user support frame. Downward movement of handle 48 as shown at arrow 54 in FIG. 11 causes link 72 to pivot clockwise as shown at arrow 106 about pivot 74, which in turn causes link 90 to move leftwardly as shown at arrow 108, which in turn causes link 80 to pivot counterclockwise as shown at arrow 110 about pivot 84, which in turn lowers roller 60 to its lowered position 46 to engage floor 62 and lift the left end of the frame, as shown at arrow 112, FIG. 13, including pads 66, 68 off of and above floor 62, and enable the frame to be re-positioned to a different location left-right, as shown at arrow 113, by rolling of roller 60 along floor 62.

Figure 13:
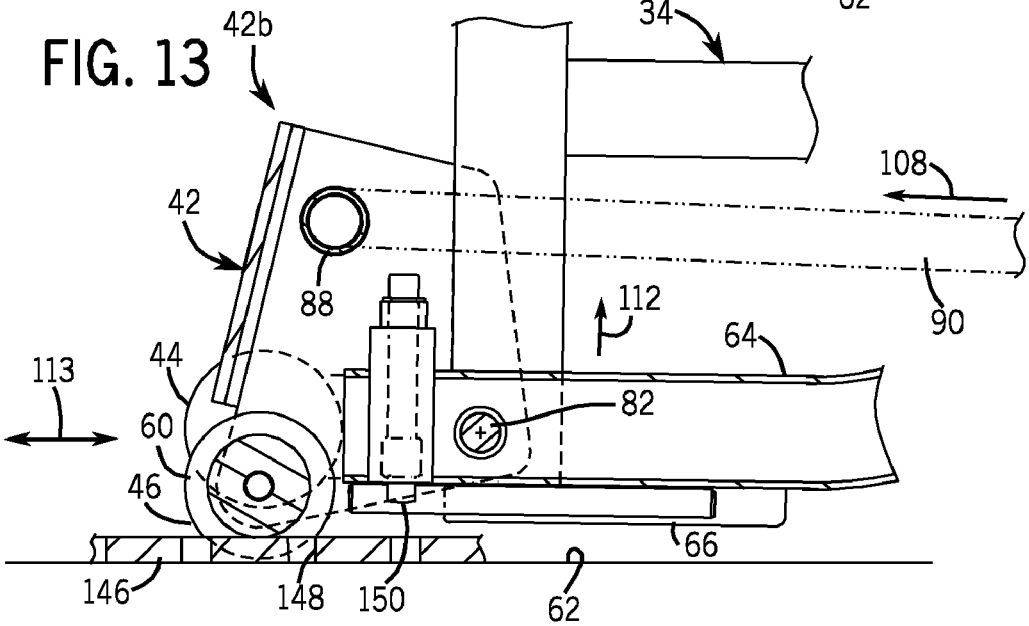
FIG. 13 is a view like FIG. 12, enlarged and partially cutaway.
Figure 14:
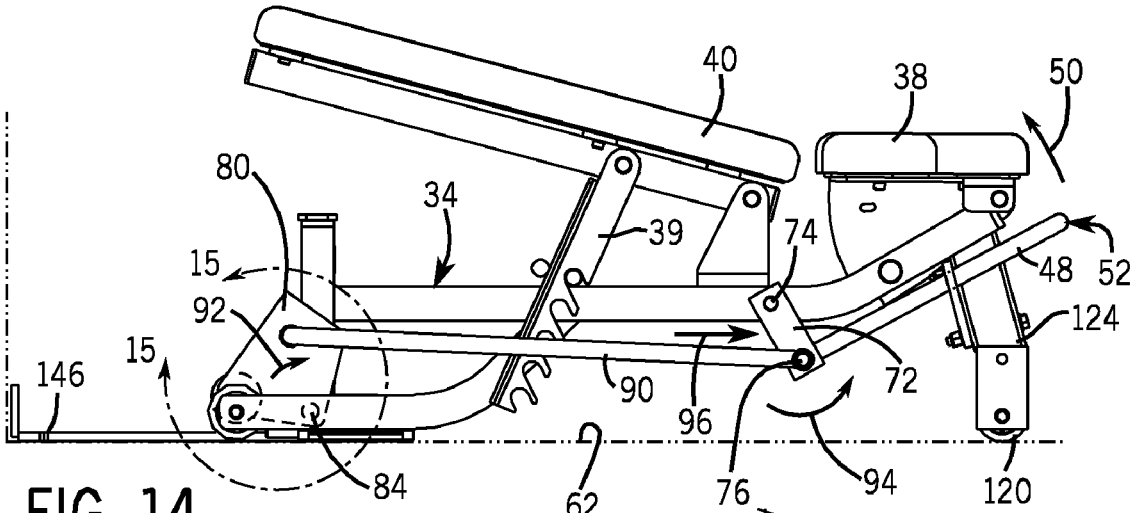
FIG. 14 is like FIG. 11 and shows a further operational mode.
Figure 15:
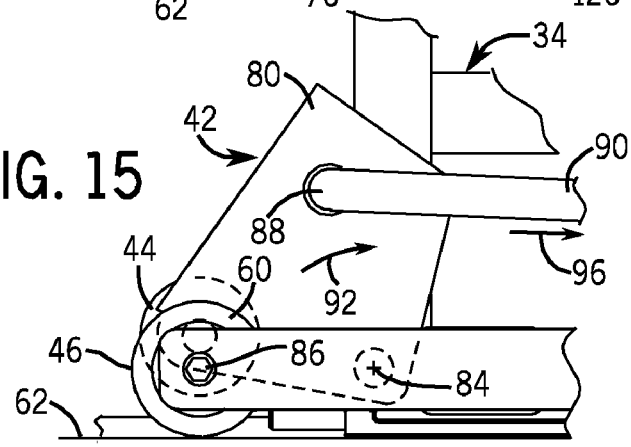
FIG. 15 is an enlarged view of a portion of the apparatus of FIG. 14 taken along line 15-15.
Figure 17:
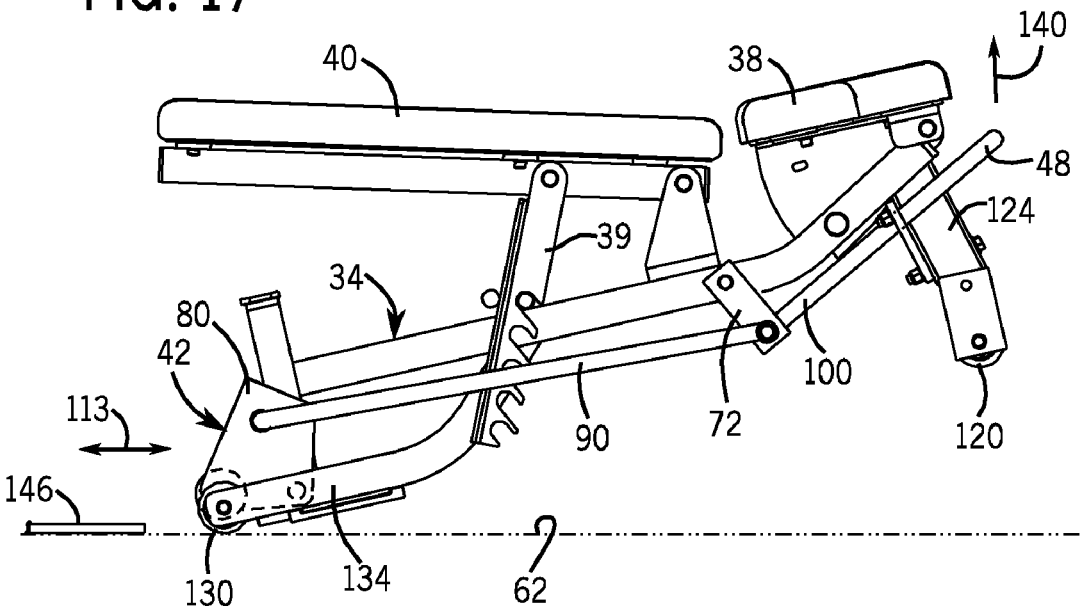
FIG. 17 is like FIG. 14 and shows a further operational mode.
Figure 18:
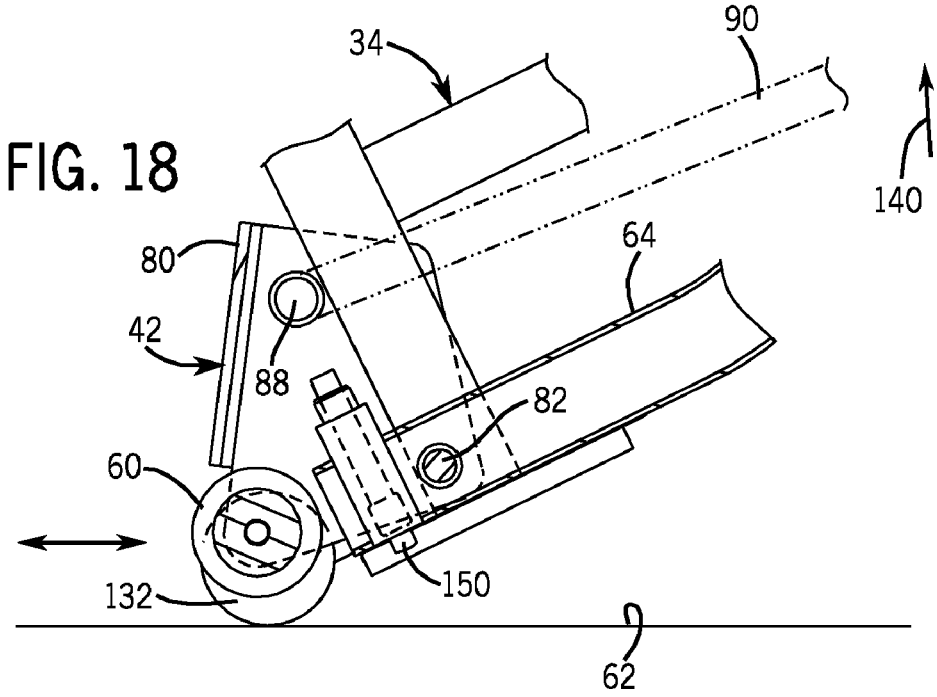
FIG. 18 is an enlarged view of a portion of FIG. 17, partially cutaway.
Figure 21:
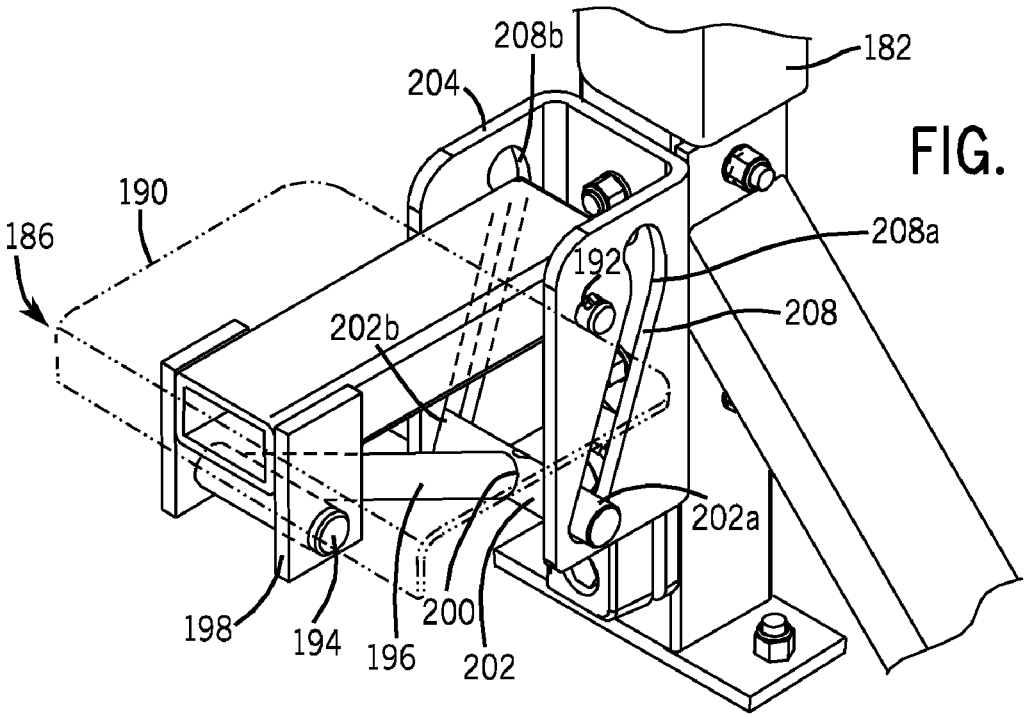
FIG. 21 is an enlarged perspective view of a portion of FIG. 1.
Figure 22:
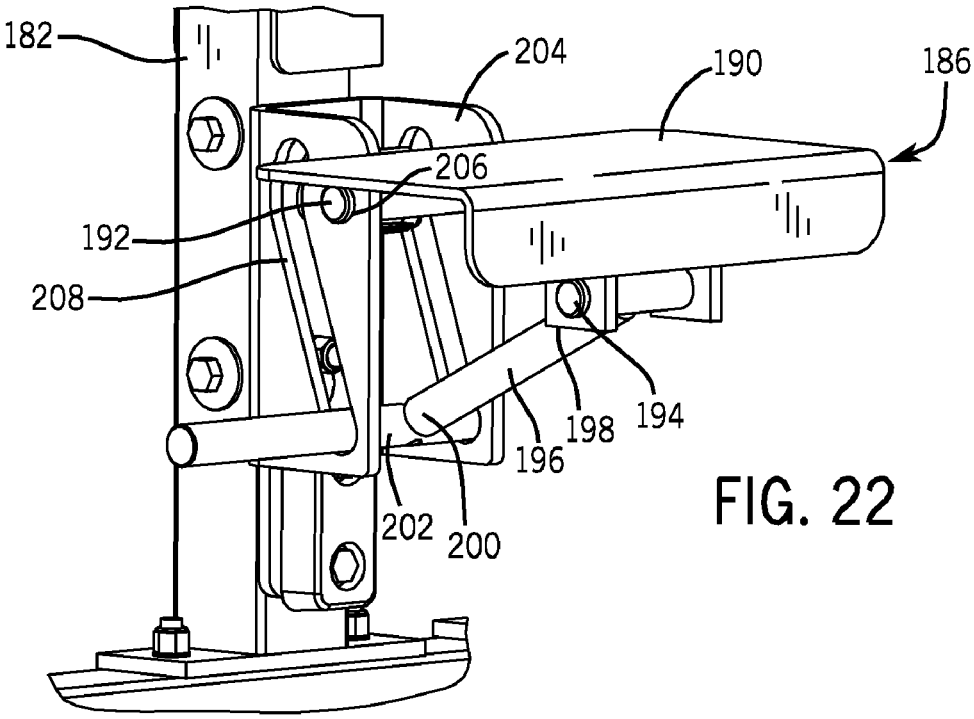
FIG. 22 is a perspective view from a different angle of the apparatus of FIG. 21.
Figure 23:
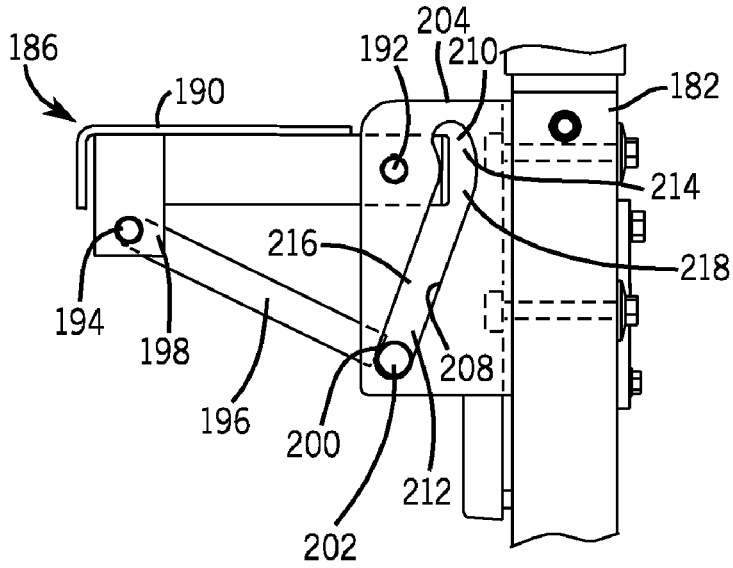
FIG. 23 is a side view of the apparatus of FIG. 21.
Figure 24:
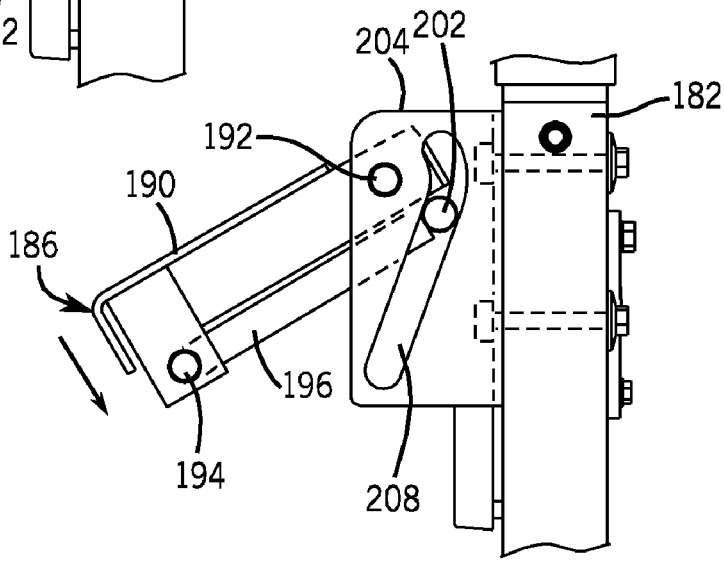
FIG. 24 is like FIG. 23 and shows sequential operation of the apparatus.

User support frame 34 is movable left-right as shown at arrow 113, FIG. 13, along longitudinal direction 114, FIG. 1, relative to dock 32 to longitudinally spaced locking locations. Roller 60 is movable relative to user support frame 34 between the noted raised and lowered positions 44 and 46, transversely of longitudinal direction 114. Roller 60 is provided by a set of one or more rollers, such as a bobbin or spindle having rollers 60*a* and 60*b* connected by a central axle 60*c*. A second set of one or more rollers such as 120, 122 are journaled to user support frame 34 at support leg 124 and are longitudinally spaced from the first set of one or more rollers 60. User support frame 34 rolls along floor 62 on the noted sets of rollers 60, 120, 122 when the first set of rollers 60 is in the noted lowered position 46. The first and second sets of rollers 60 and 120, 122 are longitudinally spaced along user support frame 34 at longitudinally distally opposite ends 126 and 128 thereof, respectively. A third set of one or more rollers such as 130, 132 are journaled to user support frame 34 at outrigger legs 134 and 136, FIGS. 6, 7, 2-5, at the noted first longitudinal end 126 thereof and roll along floor 62 when the first set of rollers 60*a*, 60*b* is in the noted raised position 44 and the noted second longitudinal end 128 of user support frame 34 is raised by the user as shown at arrow 140 in FIGS. 17, 18, to enable wheelbarrow movement of user support frame 34 on the third set of rollers 130, 132 at first longitudinal end 126 of user support frame 34. This mode may be used when user support frame 34 is disengaged from dock 32 and it is desired to move user support frame 34 to a different location remote from or otherwise spaced from dock 32 to permit access to the weight training rack thereat without bench frame 34 in the near vicinity thereof. The noted third set of rollers 130, 132 are preferably provided by a pair of outrigger rollers laterally spaced outwardly of the noted first set of rollers 60*a*, 60*b* therebetween.

Figure 3:
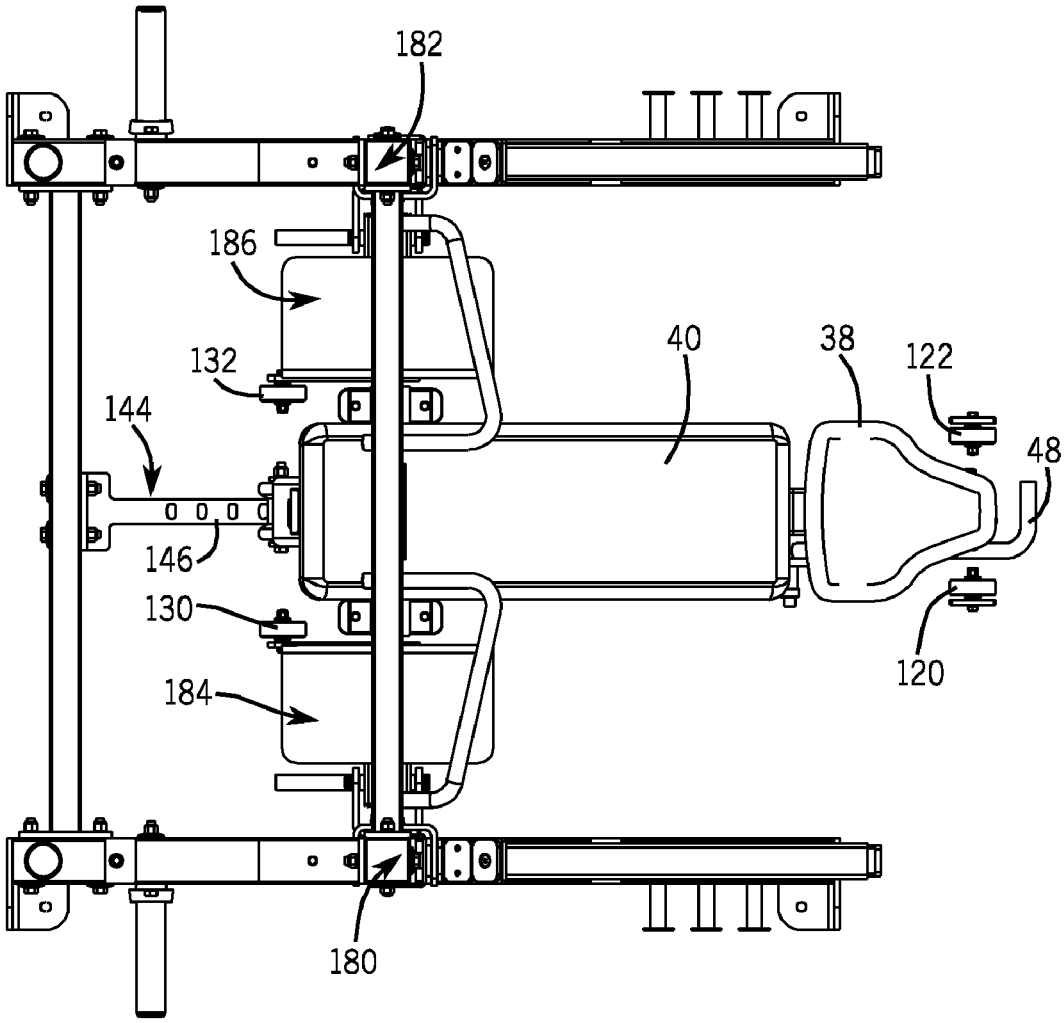
FIG. 3 is a top view of the apparatus of FIG. 1.
Figure 5:
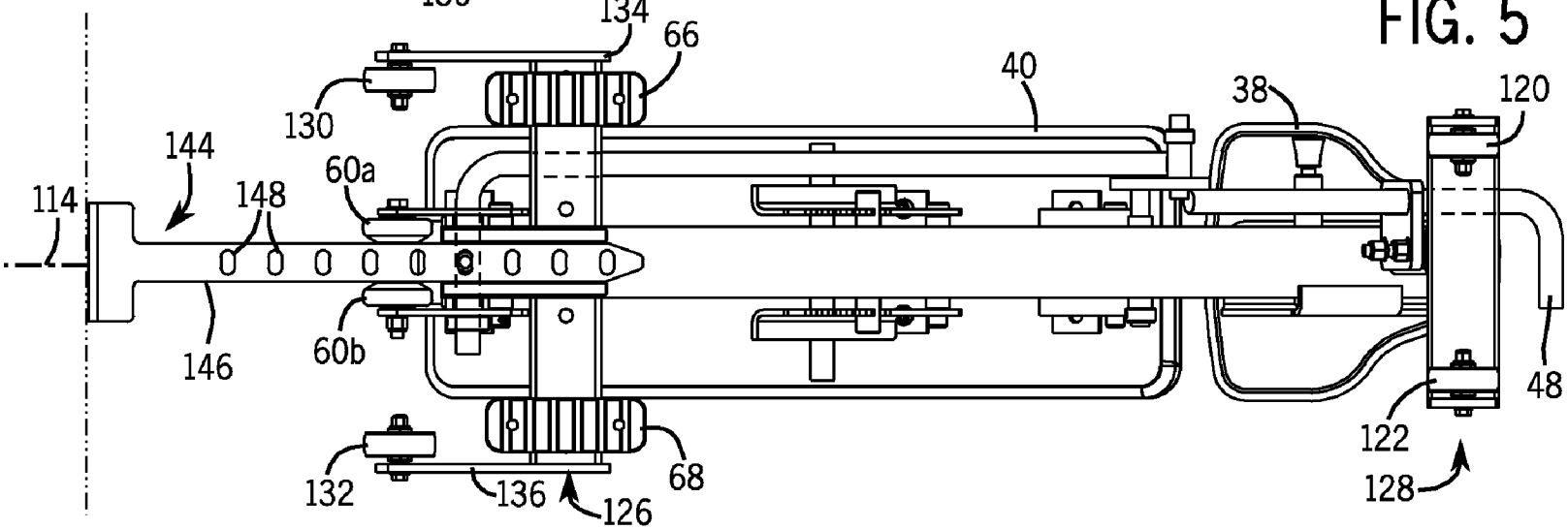
FIG. 5 is a bottom view of the apparatus of FIG. 4.

Dock 32 preferably includes an anchor portion 144, FIGS. 3-5, having a locking tongue 146 extending longitudinally therefrom along axis 114 and providing the noted plurality of locking locations longitudinally spaced along the tongue. Tongue 146 has a plurality of detents 148 longitudinally spaced therealong and providing the noted locking locations. The detents are preferably provided by slots longitudinally spaced along tongue 146. The locking member includes a locking pin 150, FIGS. 10, 19, 20, mounted to the user support frame at lower portion 64 and lowered into a respective slot 148, FIG. 20, upon lowering of the left end 126 of user support frame 34 in response to raising of roller 60. Locking pin 150 is biased downwardly toward a respective slot 148 by spring 152 which also provides lost motion when locking pin 150 is not aligned with a respective slot 148 as shown in FIG. 19. User support frame 34 is then moved left or right as shown at arrow 113 along longitudinal direction 114 until pin 150 aligns with a slot 148 and moves downwardly thereinto, FIG. 20, due to the bias of spring 152, to thus lock user support frame 34 to tongue 146 of dock 32. Roller 60 is preferably provided by the noted pair of laterally spaced rollers 60*a* and 60*b* straddling tongue 146 extending longitudinally therebetween. Roller 60 is mounted to user support frame 34 by bracket or link 80 having the noted pivot 82 connected to the user support frame 34, and the noted pivot 86 journaling roller 60, and the noted pivot 88 coupled to handle 48 through handle linkage 90, 72, 100.

In one preferred embodiment, the apparatus provides an olympic caliber weight training rack and bench including weight rack frame 32 for supporting one or more training weights, and bench frame 34 supporting a user bench 36 which may include seat 38 and seat back 40. The angle of seat back 40 may be adjusted by support arms 39, as is standard.

Figure 2:
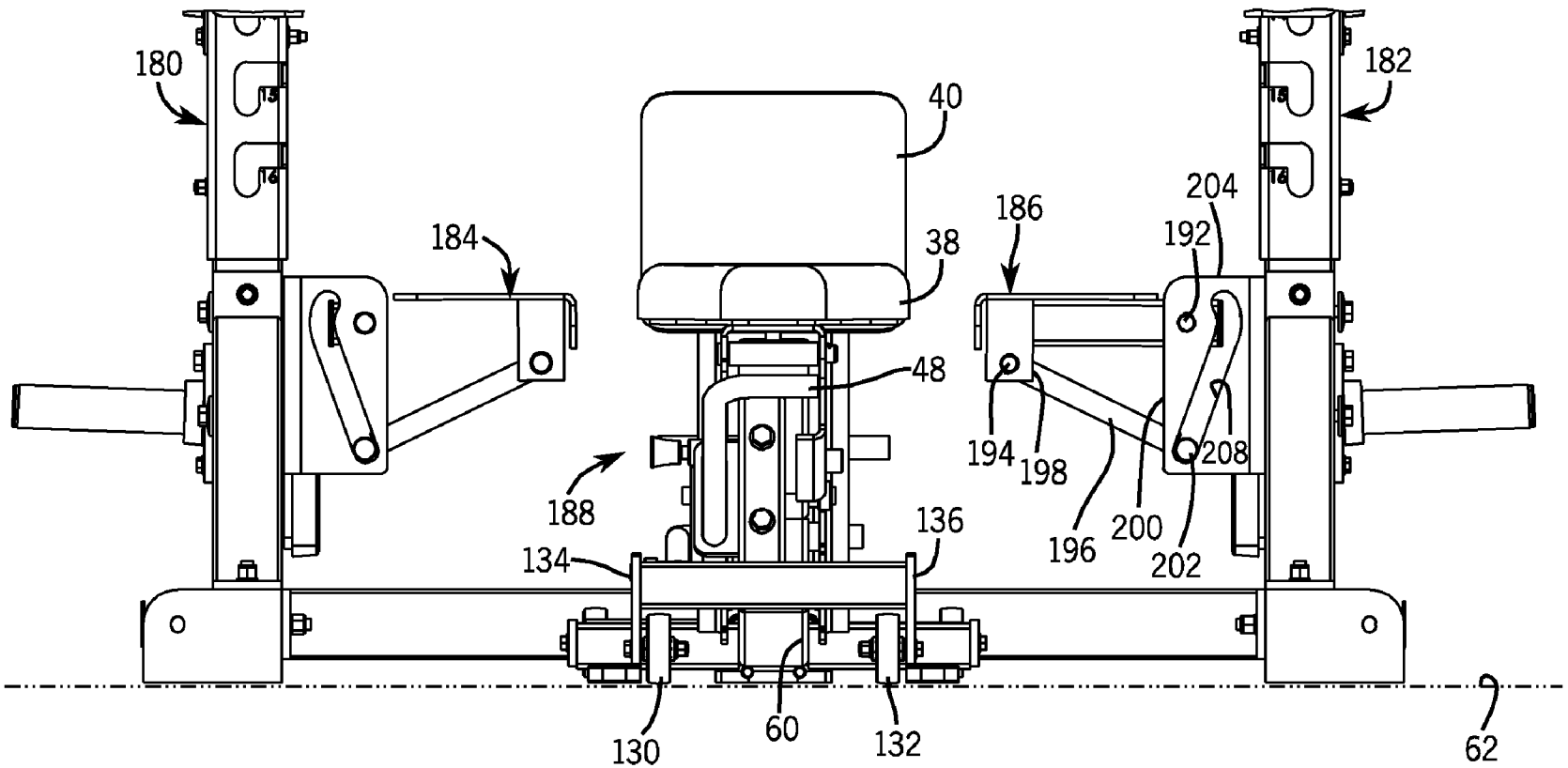
FIG. 2 is an end view of the apparatus of FIG. 1.

The noted weight training exercise equipment 30 includes the noted weight rack frame 32 having a plurality of laterally spaced upstanding support posts such as 180, 182, FIGS. 1-3. A pair of collapsible spotter platforms 184 and 186 are provided, each mounted to a respective post 180, 182. Spotter platforms 184 and 186 are laterally spaced by an open lateral gap 188 therebetween, without a lateral cross-brace between the spotter platforms, to facilitate ease of step-through for a spotter.

Figure 25:
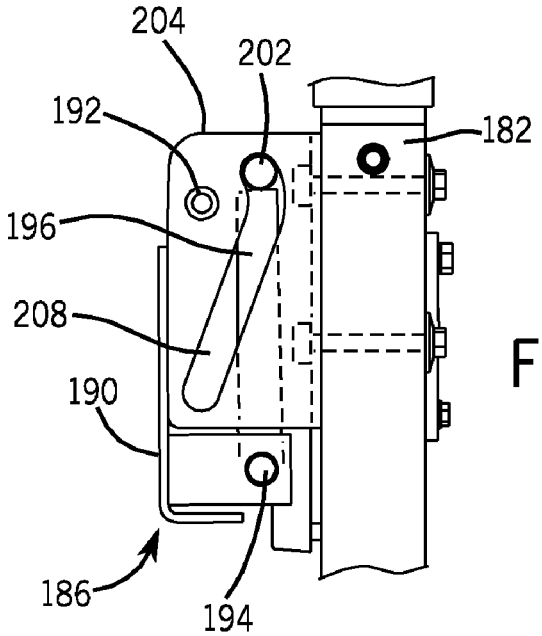
FIG. 25 is like FIG. 23 and shows the apparatus in an alternate position.

Each spotter platform 184, 186 is pivotally mounted to its respective post 180, 182 for pivotal movement between a horizontal position, FIGS. 1, 2, 22, 23, for supporting a spotter thereon, and a collapsed position, FIG. 25, occupying less horizontal area than in the horizontal position. Each spotter platform includes a step plate, such as 190, FIGS. 21-25, having a first pivot 192 pivotally mounted to its respective post, and a second pivot 194, and further includes a triangulated hypotenuse leg 196 having a first end 198 pivoted to step plate 190 at pivot 194, and having a second end 200 having a cross-bar or T-bar 202 translationally slidable along the post. The spotter platform further includes a bracket 204 mounted to the post and having a pivot mount at 206 pivotally mounting the step plate at pivot 192 and having a guide track channel 208 guiding the noted second end 200 of hypotenuse leg 196 at transverse T-bar 202 therealong. The guide track channel preferably includes a pair of spaced channels 208*a* and 208*b* each guiding a respective end of T-bar 202 at 202*a* and 202*b*, respectively. The guide track channel extends obtusely relative to upstanding post 182 and relative to the noted horizontal position, FIGS. 22, 23, of the spotter platform 190. Guide track channel 208 extends between upper and lower ends 210 and 212. Upper end 210 is at a vertically higher level than pivot 192. Lower end 212 is at a vertically lower level than pivot 192. Lower end 212 is at a vertically lower level than pivot 192 by a distance selected to provide an angle of at least 20°, and preferably about 25°, between hypotenuse leg 196 and step plate 190 when the step plate is in the noted horizontal position, FIG. 23. Guide track channel 208 extends nonrectilinearly between upper and lower ends 210 and 212. The guide track channel has upper and lower sections 214 and 216 meeting at an angled junction 218. Lower section 216 is longer than upper section 214. Angled junction 218 is preferably horizontally aligned with pivot 192.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. Exercise equipment comprising a stationary dock, a user support frame engaging said dock in docking relation and releasably lockable thereto at a plurality of selectable locking locations therealong, a locking member releasably locking said user support frame to said dock, said locking member being actuatable between a first locking position locking said user support frame to said dock at a selected one of said locking locations, and a second release position releasing said user support frame from said dock, a user-operated handle operable to a first condition which actuates said locking member to said locking position at a selected one of said locking locations, and a second condition which both: a) actuates said locking member to said release position to release said user support frame from said dock; and b) enables movement of said user support frame to a different one of said locking locations; and wherein the exercise equipment is further comprising a roller mounted to said user support frame and movable relative to said user support frame between a first raised position and a second lowered position, said roller in said lowered position engaging a floor which supports said dock, wherein moving said roller into said lowered position raises said user support frame above said floor and actuates said locking member to said release position and out of engagement with said dock, wherein moving said roller into said raised position lowers said user support frame and actuates said locking member to said locking position and enables re-engagement of said locking member with said dock.

2. The exercise equipment according to claim 1 wherein said roller in said lowered position rolls along said floor to enable re-positioning of said user support frame to a selected one of said locking locations along said dock.

3. The exercise equipment according to claim 2 wherein said handle is coupled to said roller by pivoted linkage connected to said user support frame.

4. The exercise equipment according to claim 3 wherein said linkage comprises a multi-link multi-pivot linkage comprising:

a first link having a first pivot connected to said user support frame, a second pivot, and a handle-connection portion connected to said handle;

a second link having a third pivot connected to said user support frame, a fourth pivot journaling said roller, and a fifth pivot;

a third link pivotally connected between said second pivot and said fifth pivot.

5. The exercise equipment according to claim 1 wherein:

said user support frame is movable along a longitudinal direction relative to said dock to longitudinally spaced said locking locations;

said roller is movable relative to said user support frame between said raised and lowered positions transversely of said longitudinal direction.

6. The exercise equipment according to claim 5 wherein said roller comprises a first set of one or more rollers, and comprising a second set of one or more rollers journaled to said user support frame and longitudinally spaced from said first set of rollers, said user support frame rolling along said floor on said first and second sets of rollers when said first set of rollers is in said lowered position.

7. The exercise equipment according to claim 6 wherein said first and second sets of rollers are longitudinally spaced along said user support frame at longitudinally distally opposite first and second ends thereof, respectively, and comprising a third set of one or more rollers journaled to said user support frame at said first longitudinal end thereof and rolling along said floor when said first set of rollers is in said raised position and said second longitudinal end of said user support frame is manually raised by the user to enable wheelbarrow movement of said user support frame on said third set of rollers at said first longitudinal end of said user support frame.

8. The exercise equipment according to claim 7 wherein said third set of rollers comprises a pair of outrigger rollers laterally spaced outwardly of said first set of rollers therebetween.

9. The exercise equipment according to claim 5 wherein said dock comprises an anchor portion having a locking tongue extending longitudinally therefrom and providing said plurality of locking locations longitudinally spaced along said tongue.

10. The exercise equipment according to claim 9 wherein said tongue has a plurality of detents longitudinally spaced therealong and providing said locking locations.

11. The exercise equipment according to claim 10 wherein said detents comprise slots longitudinally spaced along said tongue, said locking member comprises a locking pin mounted to said user support frame and lowered into a respective said slot upon said lowering of said user support frame in response to said raising of said roller.

12. The exercise equipment according to claim 11 wherein said locking member comprises a spring biased said locking pin mounted to said user support frame and biased toward a respective said slot by a spring providing lost motion when said locking pin is not aligned with a respective said slot.

13. The exercise equipment according to claim 9 wherein said roller comprises a pair of laterally spaced rollers straddling said tongue extending longitudinally therebetween.

14. The exercise equipment according to claim 1 wherein:

said roller is mounted to said user support frame by a bracket having first, second, and third pivots;

said first pivot is connected to said user support frame;

said second pivot journals said roller;

said third pivot is coupled to said handle through handle linkage.

15. A weight training rack and bench comprising a weight rack frame for supporting one or more training weights, a bench frame for supporting a user bench, said bench frame engaging said weight rack frame in docking relation and releasably lockable thereto at a plurality of selectable locking locations therealong, a locking member releasably locking said bench frame to said weight rack frame, said locking member being actuatable between a first locking position locking said bench frame to said weight rack frame at a selected one of said locking locations, and a second release position releasing said bench frame from said weight rack frame, a user-operated handle operable to a first condition which actuates said locking member to said locking position at a selected one of said locking locations, and a second condition which both: a) actuates said locking member to said release position to release said bench frame from said weight rack frame; and b) enables movement of said bench frame to a different one of said locking locations; and wherein the weight training rack and back is further comprising a roller mounted to said bench frame and movable relative to said bench frame between a first raised position and a second lowered position, said roller in said lowered position engaging a floor which supports said weight rack frame, wherein moving said roller into said lowered position raises said bench frame above said floor and actuates said locking member to said release position and out of engagement with said weight rack frame, wherein moving said roller into said raised position lowers said bench frame and actuates said locking member to said locking position and enables re-engagement of said locking member with said weight rack frame.

16. The weight training rack and bench according to claim 15 wherein said roller in said lowered position is rolls along said floor to enable re-positioning of said bench frame to a selected one of said locking locations along said weigh rack frame.

17. The weight training rack and bench according to claim 16 wherein said handle is coupled to said roller by pivoted linkage connected to said bench frame.

18. The weight training rack and bench according to claim 17 wherein said linkage comprises a multi-link multi-pivot linkage comprising:

a first link having a first pivot connected to said bench frame, a second pivot, and a handle-connection portion connected to said handle;

a second link having a third pivot connected to said bench frame, a fourth pivot journaling said roller, and a fifth pivot;

a third link pivotally connected between said second pivot and said fifth pivot.

19. The weight training rack and bench according to claim 15 wherein:

said bench frame is movable along a longitudinal direction relative to said weight rack frame to longitudinally spaced said locking locations;

said roller is movable relative to said bench frame between said raised and lowered positions transversely of said longitudinal direction.

20. The weight training rack and bench according to claim 19 wherein said roller comprises a first set of one or more rollers, and comprising a second set of one or more rollers journaled to said bench frame and longitudinally spaced from said first set of rollers, said bench frame rolling along said floor on said first and second sets of rollers when said first set of rollers is in said lowered position.

21. The weight training rack and bench according to claim 20 wherein said first and second sets of rollers are longitudinally spaced along said bench frame at longitudinally distally opposite first and second ends thereof, respectively, and comprising a third set of one or more rollers journaled to said bench frame at said first longitudinal end thereof and rolling along said floor when said first set of rollers is in said raised position and said second longitudinal end of said bench frame is manually raised by the user to enable wheelbarrow movement of said bench frame on said third set of rollers at said first longitudinal end of said bench frame.

22. The weight training rack and bench according to claim 21 wherein said third set of rollers comprises a pair of outrigger rollers laterally spaced outwardly of said first set of rollers therebetween.

23. The weight training rack and bench according to claim 19 wherein said weight rack frame comprises an anchor portion having a locking tongue extending longitudinally therefrom and providing said plurality of locking locations longitudinally spaced along said tongue.

24. The weight training rack and bench according to claim 23 wherein said tongue has a plurality of detents longitudinally spaced therealong and providing said locking locations.

25. The weight training rack and bench according to claim 24 wherein said detents comprise slots longitudinally spaced along said tongue, said locking member comprises a locking pin mounted to said bench frame and lowered into a respective said slot upon said lowering of said bench frame in response to said raising of said roller.

26. The weight training rack and bench according to claim 25 wherein said locking member comprises a spring biased said locking pin mounted to said bench frame and biased toward a respective said slot by a spring providing lost motion when said locking pin is not aligned with a respective said slot.

27. The weight training rack and bench according to claim 23 wherein said roller comprises a pair of laterally spaced rollers straddling said tongue extending longitudinally therebetween.

28. The weight training rack and bench according to claim 15 wherein:

said roller is mounted to said bench frame by a bracket having first, second, and third pivots;

said first pivot is connected to said bench frame;

said second pivot journals said roller;

said third pivot is coupled to said handle through handle linkage.

* * * * *